United States Patent [19]

Pure

[11] 4,281,675

[45] Aug. 4, 1981

[54] APPARATUS FOR WASHING INSULATED TRAYS

[75] Inventor: Albert Pure, Philadelphia, Pa.

[73] Assignee: Insinger Machine Company, Philadelphia, Pa.

[21] Appl. No.: 75,379

[22] Filed: Sep. 13, 1979

[51] Int. Cl.[3] ..... B08B 3/02

[52] U.S. Cl. ..... 134/125; 134/72; 134/126; 134/131; 134/199; 198/649

[58] Field of Search ..... 134/70, 72, 124–126, 134/131, 148, 151–152, 199; 198/649

[56] References Cited

U.S. PATENT DOCUMENTS

| | | | |
|---|---|---|---|
| Re. 28,174 | 9/1974 | Sabatka et al. | 134/125 X |
| 1,801,906 | 4/1931 | D'Humy et al. | 198/649 X |
| 3,675,665 | 7/1972 | Sadwith | 134/70 X |
| 3,799,386 | 3/1974 | Madalin et al. | 220/412 X |
| 3,939,854 | 2/1976 | Kitterman et al. | 134/72 X |
| 4,104,080 | 8/1978 | Sadwith | 134/152 X |

*Primary Examiner*—Robert L. Bleutge

*Attorney, Agent, or Firm*—Seidel, Gonda, Goldhammer & Panitch

[57] ABSTRACT

Washing apparatus for washing insulated trays includes an endless conveyor below the elevation of first and second guide rails which guide the trays in an upright disposition as they are being washed. The conveyor includes generally V-shaped tray supports at spaced points therealong so that each tray is supported by two adjacent tray supports. Vertically disposed manifolds have spraying nozzles for spraying water generally horizontally at opposite major faces of the trays.

9 Claims, 4 Drawing Figures

APPARATUS FOR WASHING INSULATED TRAYS

BACKGROUND

Apparatus for washing trays conventionally includes a conveyor on which the trays are horizontally supported. For example, see U.S. Pat. No. 3,939,854. Recent developments in connection with hospital food trays have resulted in insulated trays having a thickness of between 2 and 4½ inches thick. Such trays have deep pockets which are not adequately cleaned by conventional washing apparatus. See U.S. Pat. No. 3,799,386. The present invention recognizes the deficiencies of the prior washers and is directed to a novel structural interrelationship for satisfactory washing insulated trays in a reliable manner.

SUMMARY OF THE INVENTION

The present invention is directed to apparatus for washing insulated trays having pockets on a major face thereof. The apparatus includes a housing having an inlet and outlet. The width of the inlet and outlet are substantially narrower than the height so that trays to be washed will be vertically disposed and supported by a side face. First and second guide rails are provided in the housing for guiding upright trays as they are being washed in the housing. The guide rails are spaced apart slightly more than the thickness of the trays so that the trays are slightly tilted as they pass through the housing.

The apparatus includes an endless conveyor located at an elevation below the elevation of the guide rails for moving the trays through the housing. The conveyor has generally V-shaped tray supports at spaced points therealong so that each tray side face is supported by two adjacent tray supports. Nozzle means is provided on opposite sides of vertical planes containing the guide rails for spraying water generally horizontally at the opposite major face of the trays.

It is an object of the present invention to provide a novel washing apparatus for cleaning insulated trays having pockets on a major face in a more reliable manner.

It is another object of the present invention to provide apparatus for washing insulated trays in a manner so that the trays are generally vertically disposed while being washed.

It is another object of the present invention to provide appartus for washing and sanitizing insulated trays having deep pockets on a major face thereof whereby all surfaces on the major faces of the trays are exposed and wetted.

Other objects will appear hereinafter.

For the purpose of illustrating the invention, there is shown in the drawings a form which is presently preferred; it being understood, however, that this invention is not limited to the precise arrangements and instrumentalities shown.

Referring to the drawings in detail, wherein like numerals indicate like elements, there is shown in FIG. 1 a washing apparatus in accordance with the present invention and designated generally as 10.

Figure 1:
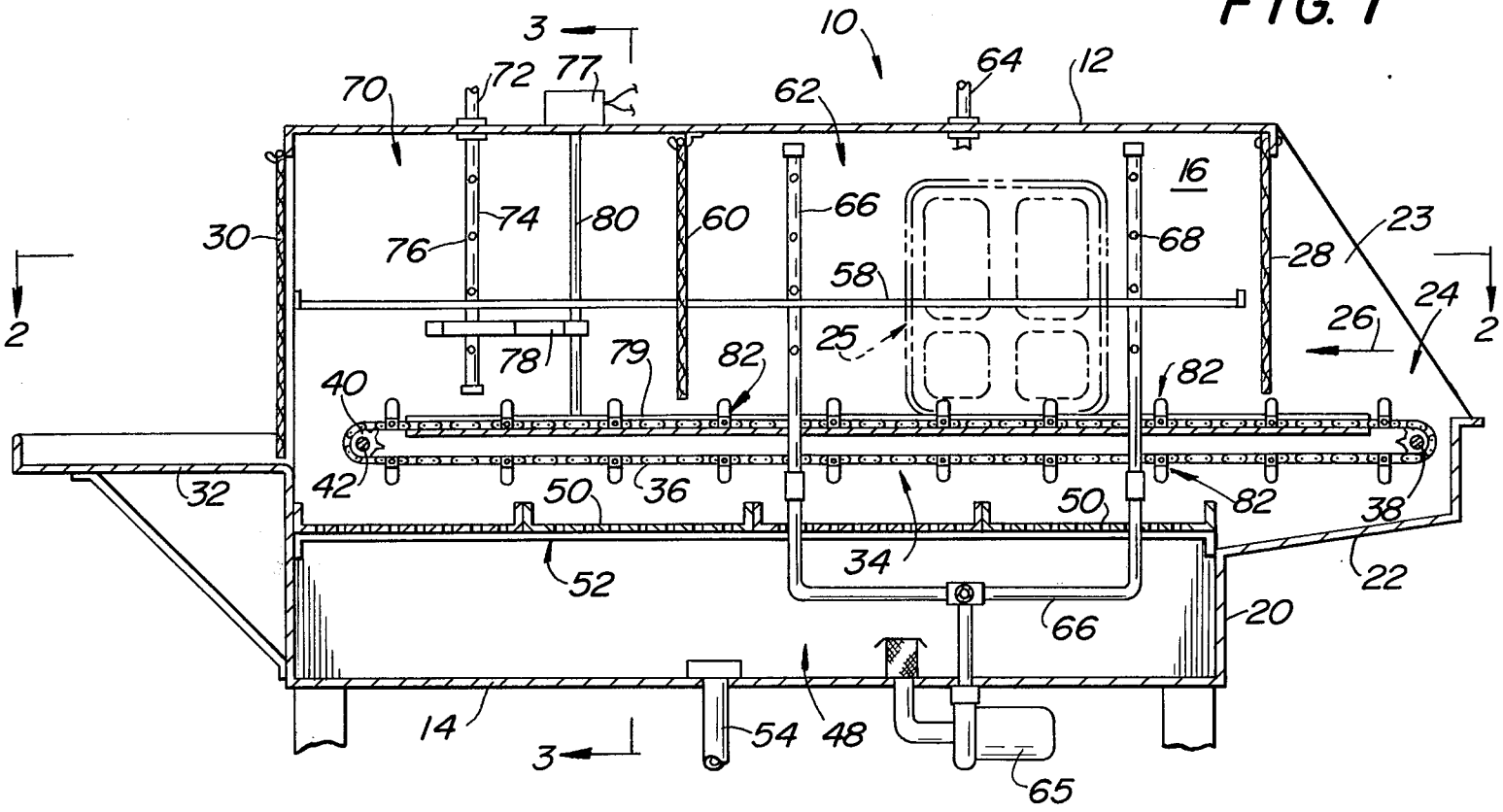
FIG. 1 is a vertical sectional view of the apparatus of the present invention.

The apparatus 10 includes a housing defined primarily by top wall 12, bottom wall 14, side walls 16 and 18, a front wall and a rear wall. The front wall 20 has a forwardly projecting portion 22 which defines a loading area 24. Trays 25 are positoned over the loading area 24 and introduced into the housing in the direction of arrow 26 between walls 23. The forward edges of walls 23 define an inlet and are cut on a bias of about 60° as shown in FIG. 1.

Adjacent the loading area 24, the inlet to the housing is temporarily closed by a flexible curtain 28. Curtain 28 prevents water from splashing into the loading area 24 but is sufficiently flexible so as to be moved to one side by the tray 25 as it is introduced through the inlet. The inlet is substantially higher than its transverse dimensions. Thus, a typical inlet may be 20 inches high and 6 inches wide. These dimensions may be varied.

The housing includes an outlet of similar heights to the inlet with a width extending across the housing and temporarily closed by a curtain 30. Curtain 30 prevents water or other washing liquid from splashing out of the housing onto the outlet platform 32. The inlet and outlet are aligned with one another. The platform 32 is preferably as wide as the housing. See FIG. 2.

Trays 25 are moved through the housing from the inlet to the outlet by a conveyor designated generally as 34. The conveyor 34 includes an endless conveyor chain 36 extending around sprockets 38 and 40. Sprocket 40 is mounted on a drive shaft 42 which extends transversly between the side walls 16 and 18. See FIG. 3. Outside of the housing, drive shaft 42 has a sprocket or gear meshed with a chain 44. Chain 44 is meshed with a gear or sprocket on the output shaft of a gear motor 46. Thus, gear motor 46 moves the conveyor chain 36 around the sprockets 38, 40 to move trays 25 from the inlet to the outlet. The gear motor 46 is preferably provided with a friction type disk clutch to prevent damage in the event of a jam-up.

A sump 48 is provided within the housing between the bottom wall 14 and the elevation of the conveyor 34. The upper limit of the sump 48 is defined by a series of aligned removable perforated trays 50. Opposite side edges of the trays 50 are supported by longitudinally disposed parellel brackets 52. Each of the trays 50 may be individually removed. The trays accumulate larger size particles which are not intended to enter the sump 48. The sump 48 is provided with an outlet drain 54. The side wall 16 or side wall 18 is provided with removable panels such as panel 51 to facilitate access to remove the trays 50.

First and second guide rails 56 and 58 are supported within the housing and extend longitudinally of the housing. See FIGS. 1 and 2. As shown more clearly in FIGS. 1 and 3, the guide rails 56, 58 are at an elevation above the elevation of the conveyor 34 and are spaced apart by a distance substantially greater than the thickness of the tray 25 so that the tray 25 will be tilted to one side by a small angle with respect to the vertical such as 5°–10° . The guide rails 56, 58 are equidistant from and on opposite sides of a vertical plane containing the center line of the conveyor 34.

A flexible curtain 60 is provided within the housing intermediate the inlet and outlet. Curtain 60 cooperates with curtain 28 to define a washing chamber 62. A water supply conduit 64 enters the housing in any convenient location such as through the top wall 12. Conduit 64 is connected to a valve (not shown) which fills the sump 48 with water. A high pressure pump 65 has its inlet in communication with sump 48 and its outlet is connected to a manifold 66. The leg portions of the manifold 66 have nozzles 68 at spaced points therealong. Each of the nozzles 68 direct water generally horizontally at the opposite major faces of the trays 25. As shown more clearly in FIGS. 2 and 3, there is a manifold 66 on opposite sides of the tray 25. The nozzles 68 may discharge water or a mixture of water and detergent at spray pressures up to 20 psi. A typical temperature of the water is mintained in the range of 140°–160° F. with delivery being approximately 70 gallons per minute. Conveyor 34 is preferably driven at a speed so that the trays 25 are subjected to spraying for approximately 8 to 10 seconds.

Curtain 60 cooperates with curtain 30 to define a sanitizing chamber 70. A conduit 72 is connected to a manifold 74. Manifold 74 has nozzles 76 at spaced points therealong for discharging a sanitizing liquid generally horizontally at the opposite major faces of the tray 25. As shown more clearly in FIG. 2, two such manifolds 34 are provided on opposite sides of the chamber 70.

Within the sanitizing chamber 70 or at any other desired location, there is provided a switch arm 78 pivotably supported in a position so as to be transverse of the path of the movement of the trays 25. A tray 25, as it moves through the housing, contacts the switch arm 78 and moves it clockwise from the position shown in FIG. 2 to an operative disposition. Arm 78 is connected to a vertically disposed rotatable rod 80 which in turn is connected to a valve (not shown) and a chemical pump which allows chemically treated water to pass through manifold 74 and nozzles 76 onto the tray 25. After tray 25 passes through machine 10, the flow through nozzles 76 is interrupted.

Rod 80 also connects to a timer 77. Timer 77 is connected by wires not shown to the motor 46 to deactivate the motor and the pump 65 after a predetermined period of time during which no trays have passed through the housing. Thus, the apparatus 10 will shut itself off after a predetermined set period of time which is adjustable at the timer 77 if no trays are being processed. A separate control panel initiates operation of the motor 36 notwithstanding the timer 77 and overrides the same when it is desired to start up the apparatus 10.

Figure 2:
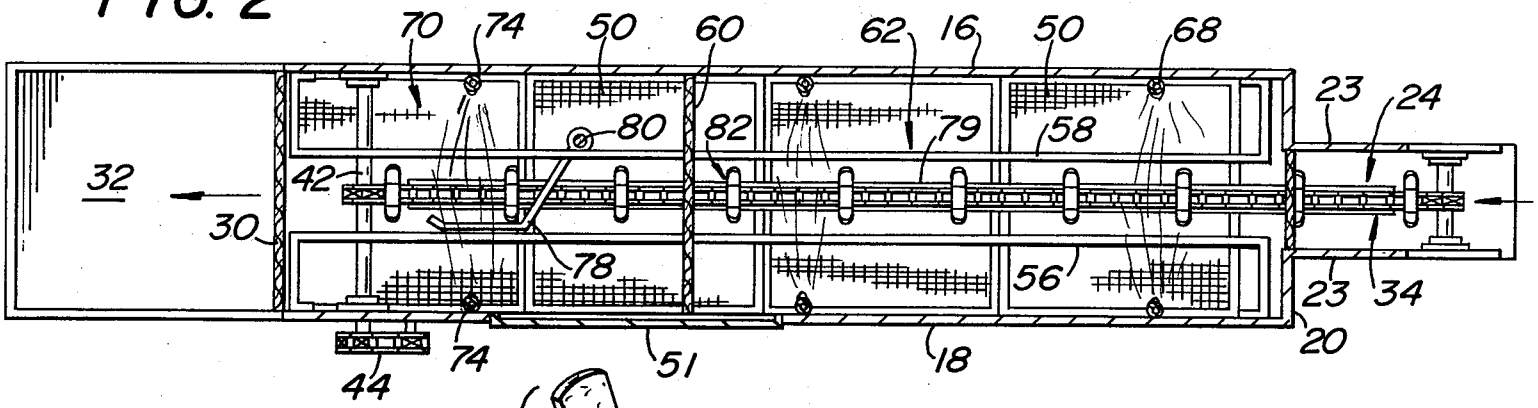
FIG. 2 is a sectional view taken along the line 2—2 in FIG. 1.
Figure 3:
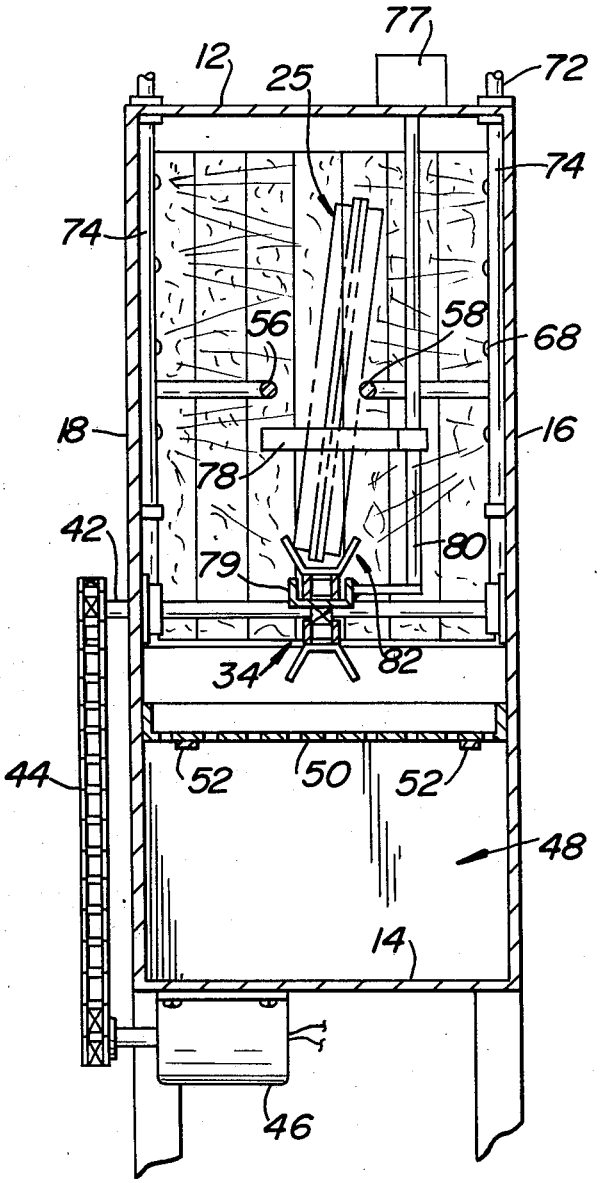
FIG. 3 is a sectional view taken along the line 3—3 in FIG. 1.

As shown more clearly in FIG. 2 and 3, the upper run of the conveyor chain 36 rides in a U-shaped track 79. As shown more clearly in FIG. 4, the conveyor chain 36 at spaced points therealong is provided with tray supports 82. The spacing between tray supports 82 is such that two adjacent supports 82 will cooperate in supporting a side face of the tray 25 as shown more clearly in FIG. 1.

Figure 4:
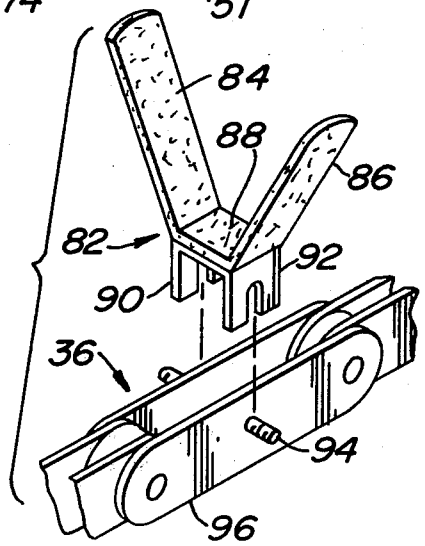
FIG. 4 is an exploded view of a tray support and a portion of the conveyor chain.

Referring to FIG. 4, each tray support 82 includes angularly disposed legs 84, 86 connected to a bight 88. The legs 84, 86 and the bight 88 are provided with a non-slip polymeric plastic material.

The tray supports are generally V-shaped with the approximate angle of legs 84 and 86 being 45° from the vertical as shown in FIG. 3. In this manner, the tray supports 82 can be utilized in connection with trays 25 having a thickness from about 2 inches up to about 4½ inches.

The bight 88 is connected to a U-shaped mounting member having notch legs 90, 92. The notch in each of the legs 90, 92 cooperates with a separate pin 94 on opposite sides of a link 96 of the chain 36. The legs 90, 92 are retained on their respective pins 94 by a wing nut or the like not shown. Thus, the tray supports 82 are readily removable for repair or maintenance and/or for adjusting the distance between adjacent tray supports 82 by moving a support to the next link.

When the trays are washed with water containing a detergent discharged from nozzles 68, the curtain 60 prevents the spray from entering into the chamber 70. The nozzles 76 on the manifold 74 may discharge rinse water or a water containing a sanitizer such as sodium hypochlorate. The water supply system is designed to operate at commercially available pressures. Detergent or sanitizing agents may be introduced into the pipes 64 and 72 in any convenient manner such as by a venturi action.

Various types of unlaoding tables or take-away conveyors may be utilized in place of the platform 32. Further, a blower-dryer may be provided at or adjacent to the platform 32 to expedite drying of the trays. Water from the sump 34 may be recirculated through a reheater such as a steam coil or may be heated by an immersion heater.

Thus, I have described a novel washing apparatus for cleaning insulated trays whose thickness and transverse dimensions may vary within predetermined ranges so as to cover most of the commercially used trays. At the same time, the components are interrelated in a manner so as to reliably clean and/or sanitize the trays and solves the problem of the prior art when the trays have deep pockets which must be completely wetted and exposed to spray liquid.

The present invention may be embodied in other specific forms without departing from the spirit or essential attributes thereof and, accordingly, reference should be made to the appended claims, rather than to the foregoing specification, as indicating the scope of the invention.

I claim:

1. Apparatus for washing insulated trays having pockets on a major face thereof comprising a housing having an inlet and an outlet, the width of the inlet being substantially narrower than the height thereof so that the trays to be washed will be vertically disposed and supported by a side face, first and second guide rails in said housing for guiding upright trays as they are being washed in said housing, said rails being spaced apart slightly greater than the thickness of the trays so that the trays will tilt slightly from the vertical while being washed, an endless conveyor below the elevation of said guide rails for moving trays from said inlet through said housing to said outlet, motor means for driving said conveyor, said conveyor having trays supports at spaced points there along so that each trays side face is suported by two adjacent tray supports, said tray supports being generally V-shaped when viewed in the direction of travel, and nozzle means on opposite sides of vertical planes containing the longitudinal axes of the rails for spraying water generally horizontally at the opposite major faces of the trays.

2. Apparatus in accordance with claim 1 wherein said tray supports have a plastic coating to provide a non-slip surface for contact with a side face of trays to be washed.

3. Apparatus in accordance with claim 1 wherein said conveyor includes an endless conveyor chain, said tray supports being removably attached to said chain.

4. Apparatus in accordance with claim 1 including means above the top run of the chain for disabling said motor after a predetermined period of time during which no trays are moved through the housing.

5. Apparatus in accordance with claim 1 wherein said nozzle means includes vertically disposed manifold conduits having a plurality of nozzles at spaced points therealong.

6. Apparatus in accordance with claim 1 wherein the height of said inlet is about three times the width of the inlet, said housing having a loading area projecting forwardly of the inlet and containing one end portion of the conveyor, and platform means at the other end of the housing for receiving cleaned trays discharged through the outlet.

7. Apparatus in accordance with claim 1 including a loading area projecting forwardly of the inlet, said loading area being defined by vertically disposed walls whose forward edge is cut on a bias, said loading area including a portion of said conveyor exposed between said last-mentioned walls.

8. Apparatus for washing insulated trays having pockets on a major face thereof comprising a housing having an inlet and an outlet, the width of the inlet being substantially narrower than the height thereof so that trays to be washed will be vertically disposed and supported by a side face, first and second guide rails in said housing for guiding upright trays as they are being washed in said housing, said rails being spaced apart slightly greater than the thickness of the trays so that trays will tilt slightly from the vertical while being washed, an endless conveyor below the elevation of said guide rails for moving trays from said inlet through said housing to said outlet, motor means for driving said conveyor, said conveyor having generally V-shaped tray supports at spaced points therealong so that each tray side face is supported by two adjacent tray supports, said tray supports having a plastic coating to provide a non-slip surface for contact with a side face of trays to be washed, said conveyor including an endless conveyor chain, said tray supports being removably attached to said chain, nozzle means on opposite sides of vertical planes containing the longitudinal axes of the rails for spraying water generally horizontally at the opposite major faces of the trays, said nozzle means including vertically disposed manifold conduits having a plurality of nozzles at spaced points therealong, and a loading area projecting forwardly of the inlet, said loading area being defined by vertically disposed walls whose forward edges are at an acute angle relative to the horizontal, said loading area including a portion of said conveyor exposed between said last-mentioned walls.

9. Apparatus for cleaning trays with a washing or sanitizing liquid comprising a housing having an inlet and an outlet, the width of the inlet being substantially narrower than the height thereof so that trays to be cleaned will be vertically disposed and supported by a side face, first and second guide rails in said housing for guiding upright trays as they are moved through said housing, said rails being spaced apart slightly greater than the thickness of the trays so that trays will tilt slightly from the vertical while being washed, an endless conveyor below the elevation of said guide rails for moving trays from said inlet through said housing to said outlet, motor means for driving said conveyor, said conveyor having generally V-shaped tray supports at spaced points therealong so that each tray side face is supported from below by two adjacent tray supports, said tray supports having a coating to provide a non-slip surface for contact with a side face of trays to be washed, said conveyor including an endless conveyor chain, said tray supports being attached to said chain, nozzle means on opposite sides of vertical planes containing the longitudinal axes of the rails for spraying a washing or sanitizing liquid generally horizontally at the opposite major faces of the trays, and said nozzle means including vertically disposed manifold conduits having a plurality of nozzles at spaced points therealong.

* * * * *